US006018319A

United States Patent [19]

Lindmark

[11] Patent Number: 6,018,319

[45] Date of Patent: Jan. 25, 2000

[54] ANTENNA ELEMENT

[75] Inventor: Bjorn Lindmark, Stockholm, Sweden

[73] Assignee: Allgon AB, Akersberga, Sweden

[21] Appl. No.: 09/027,933

[22] Filed: Jan. 23, 1998

[30] Foreign Application Priority Data

Jan. 24, 1997 [SE] Sweden ..... 9700208

[51] Int. Cl.[7] ..... H01Q 1/38

[52] U.S. Cl. ..... 343/700 MS; 343/767; 343/770

[58] Field of Search ..... 343/700 MS, 767, 343/770

[56] References Cited

U.S. PATENT DOCUMENTS 5,668,558 9/1997 Hong ..... 343/700 MS
5,896,107 4/1999 Huynh ..... 343/700 MS

*Primary Examiner*—Don Wong
*Assistant Examiner*—Hoang Nguyen
*Attorney, Agent, or Firm*—Jacobson, Price, Holman & Stern, PLLC

[57] ABSTRACT

A substantially flat, aperture-coupled antenna element of the kind comprising a multilayer structure with a radiating patch (2) arranged on a dielectric layer (1), an electrically conductive ground plane layer (3) having a cross-shaped aperture (4) with two crossing slots (4*a*, 4*b*) being centered in relation to the patch, and a dielectric board provided with a feed network (6) for feeding microwave energy via feed elements (7, 8) and said cross-shaped aperture (4) to said patch so as to cause the latter to generate a dual polarized microwave beam propagating from the antenna element. The multilayer structure includes a single dielectric board (5) provided with a planar feed network (6) having a first feed element (7) with a pair of feed lines extending symmetrically on each side of the aperture centre (4*c*) and a second feed element (8) with a single feed line located unsymmetrically at one said of said aperture centre without crossing said first feed element, the two feed elements (8, 7) being oriented and dimensioned so as to excite each one of the slots (4*a*, 4*b*) separately from a respective microwave channel.

8 Claims, 3 Drawing Sheets

ANTENNA ELEMENT

BACKGROUND OF THE INVENTION

1. Field of the Invention

The present invention relates to an antenna element, especially an antenna element for use in base station antennas for mobile communications.

2. Description of the Related Art

Such antenna elements are previously known, e.g., from the U.S. Pat. No. 5,080,961 (Tsao) and an article in Electronic Letters, vol. 30, No. 22, pp. 1814–1815, 1994 (Yamazaki). In order to obtain a relatively broad bandwidth and dual polarisation with a high degree of isolation between the two channels, it has been necessary, hitherto, to arrange an air-bridge in a planar feed network (as proposed by Tsao) or to dispose two different dielectric boards separated by the ground plane layer (as proposed by Yamazaki). These measures involve serious complications in the design process and the manufacture or increased costs because of the two separate dielectric boards with associated feed networks.

SUMMARY OF THE INVENTION

With this background, the main object of the present invention is to provide a simpler and less expensive antenna element while retaining the advantageous feature of a cross-shaped aperture being centered in relation to the patch. In particular, a specific object is to provide an antenna structure having a single dielectric board with an associated feed network.

According to the invention, these objects are achieved in that the multilayer structure includes a single dielectric board provided with a planar feed network having a first feed element with a pair of feed lines extending symmetrically on each side of the aperture centre and a second feed element with a single feed line located unsymmetrically at one side of said aperture centre without crossing said first feed element, the two feed elements being oriented and dimensioned so as to excite each one of the slots separately from a respective microwave channel.

The crucial feature is the arrangement where only one feed element is symmetric, whereas the other feed element is unsymmetric in relation to the centre of the cross-shaped aperture, which makes it possible to avoid any crossing point between the feed lines although the feed network is extended in a single planar configuration. Because of the unsymmetric feeding arrangement, it is impossible to accomplish a completely balanced excitation of the associated slot. However, it has turned out that the imbalance of the excited field in this slot may be limited to an acceptable level, especially if one feed element is located quite close to the aperture centre and preferably closer to the centre than the symmetric feed element, which is divided into two feed lines.

In a preferred embodiment, the feed lines, in particular in the form of micro strips, of the first feed element extend substantially in parallel to each other and perpendicularly to the associated slot, whereas the second feed element is located between but at a distance from the end portions of the feed lines of the first feed element.

These and other features are stated in the appended claims and will appear from the detailed description below.

BRIEF DESCRIPTION OF THE DRAWINGS

The invention will now be explained further with reference to the drawings illustrating a preferred embodiment of the invention.

DETAILED DESCRIPTION OF THE PREFERRED EMBODIMENTS

Figure 1:
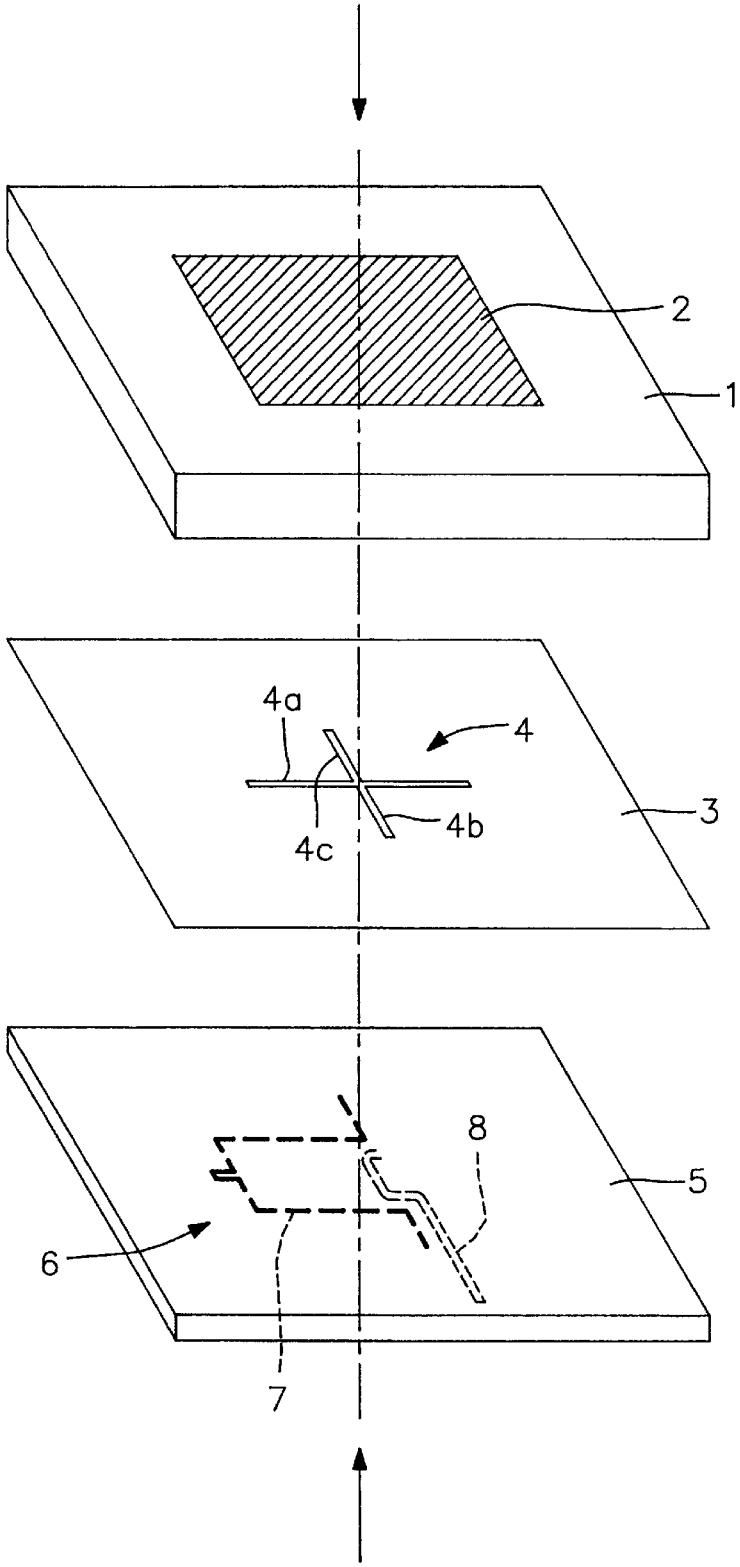
FIG. 1 shows, in an exploded perspective view, an antenna element according to the invention.

The antenna element schematically shown in FIG. 1 comprises a multilayer structure including an upper, relatively thick dielectric layer 1 provided with a rectangular patch 2, which constitutes the radiating part of the antenna element, an electrically conductive ground plane layer 3 having a centrally located, cross-shaped aperture 4 in registry with the patch 2, and a lower dielectric, relatively thin board or substrate 5 having a feed network 6 in a planar configuration at the underside thereof, i.e. at the side facing away from the cross-shaped aperture 4 so as to secure a distance therebetween corresponding to the thickness of the board 5.

In the illustrated example, the upper layer 1 has a thickness of about 15 mm and is made of Rohacell foam material. The patch 2 is made of aluminium foil and has a thickness of 50 $\mu$m and a size of 54×50 mm.

The cross-shaped aperture 4 is centered under the patch 2 and consists of two mutually perpendicular slots 4*a,* 4*b* which cross each other at a point 4*c* located centrally under the patch 2. One slot 4*a* is just as long as the longer side of the patch, i.e. 54 mm, whereas the other slot 4*b* is somewhat shorter than the shorter side of the patch, viz. 44 mm. The width of each slot 4*a,* 4*b* is 2 mm. Compare also FIG. 2, where the rectangular configuration corresponds to the patch 2.

Figure 2:
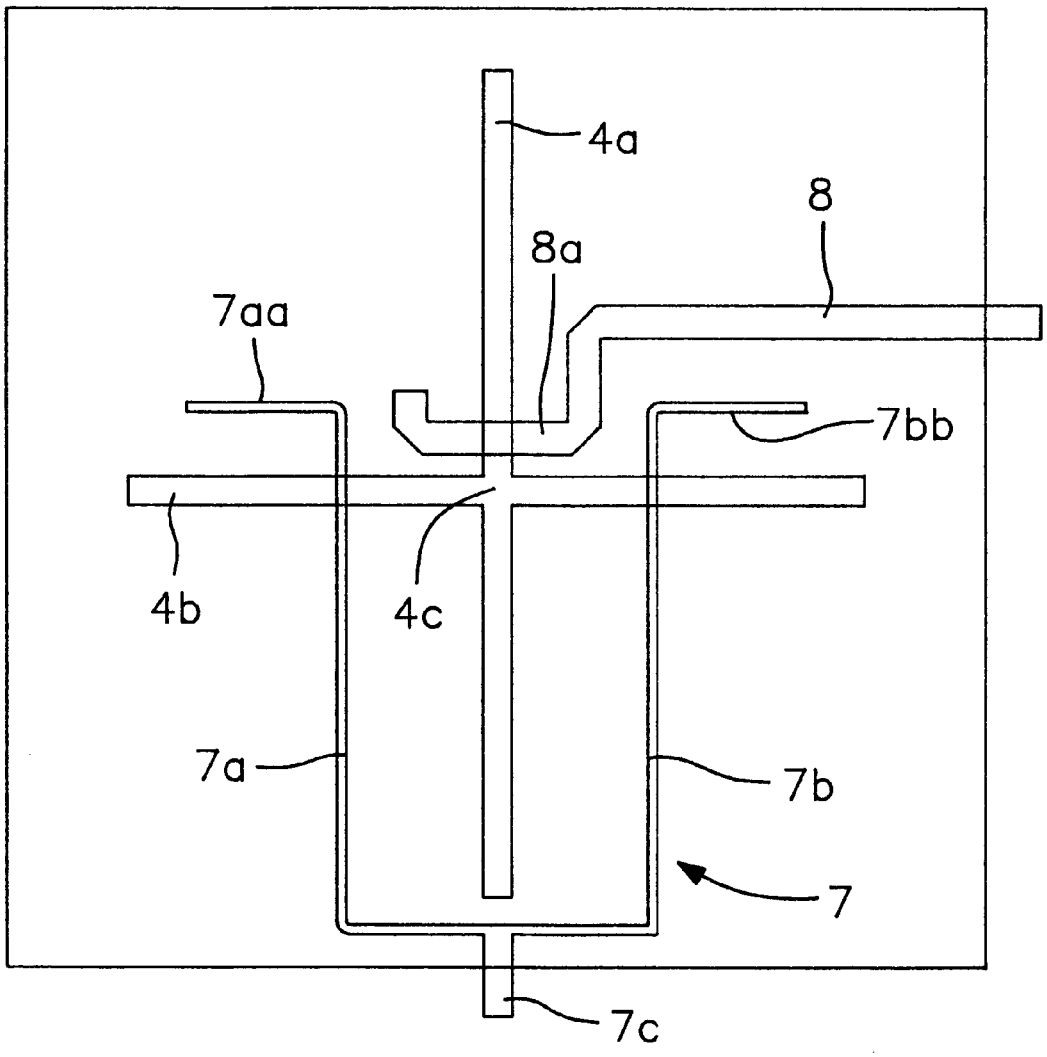
FIG. 2 shows, in a planar view (from above), the two feed elements and the cross-shaped aperture shown in FIG. 1.

The feed network 6 shown in FIGS. 1 and 2 consists of micro strip lines disposed in a single plane at the underside of the board 5. The board 5 is made of a dielectric material (DiClad) and has a thickness of 0.7 mm corresponding to the distance between the feed network and the cross-shaped aperture 4.

The feed network 6 includes two feed elements 7 and 8 located and dimensioned so as to excite an electric field in the respective aperture slot 4*b,* 4*a,* each feed element being associated with a respective one of two dual polarized microwave channels of the antenna element.

The first feed element 7 is designed in a manner known per se, with a fork-like configuration including two parallel micro strip lines 7*a,* 7*b* (each 100 Ω) branched off from a common feed line 7*c* (50 Ω). The free end portions or stubs 7*aa* and 7*bb* each extend a distance of about 15 mm past the associated slot 4*b.* As shown clearly in FIG. 2, the feed lines 7*a,* 7*b* are symmetrical with respect to a linear axis passing through the central point 4*c* (along the slot 4*a*). As also known per se, the end portions 7*aa,* 7*bb* are bent sideways so as to secure the desired impedance matching.

The second feed element 8 (50 Ω), on the other hand, is unsymmetrically disposed on one side of the central point 4*c,* at a distance therefrom. In this way, only one leg of the slot 4*a* is fed with microwave energy. Nevertheless, the coupling to the patch 2 is sufficient for obtaining a good operation of the associated channel as well. The second feed line 8 is displaced towards the central point 4*c* in its active portion 8*a* in the vicinity of the slot 4*a.* Thus, the portion 8*a* is located closer to the central point 4*c* than the feed lines 7*a,*

7*b* and extends therebetween without making contact. In this active portion 8*a,* the feed line extends a distance of about 7 mm past the associated slot 4*a*.

Accordingly, the feed lines 7*a,* 7*b,* 8 are all located in a common single plane and do not cross or contact each other at any point. This makes the design procedure and the manufacture relatively easy. Of course, the provision of only a single dielectric board 5 with an associated feed network 6 will secure a considerable cost saving as compared to the double feed networks normally used today.

Figure 3:
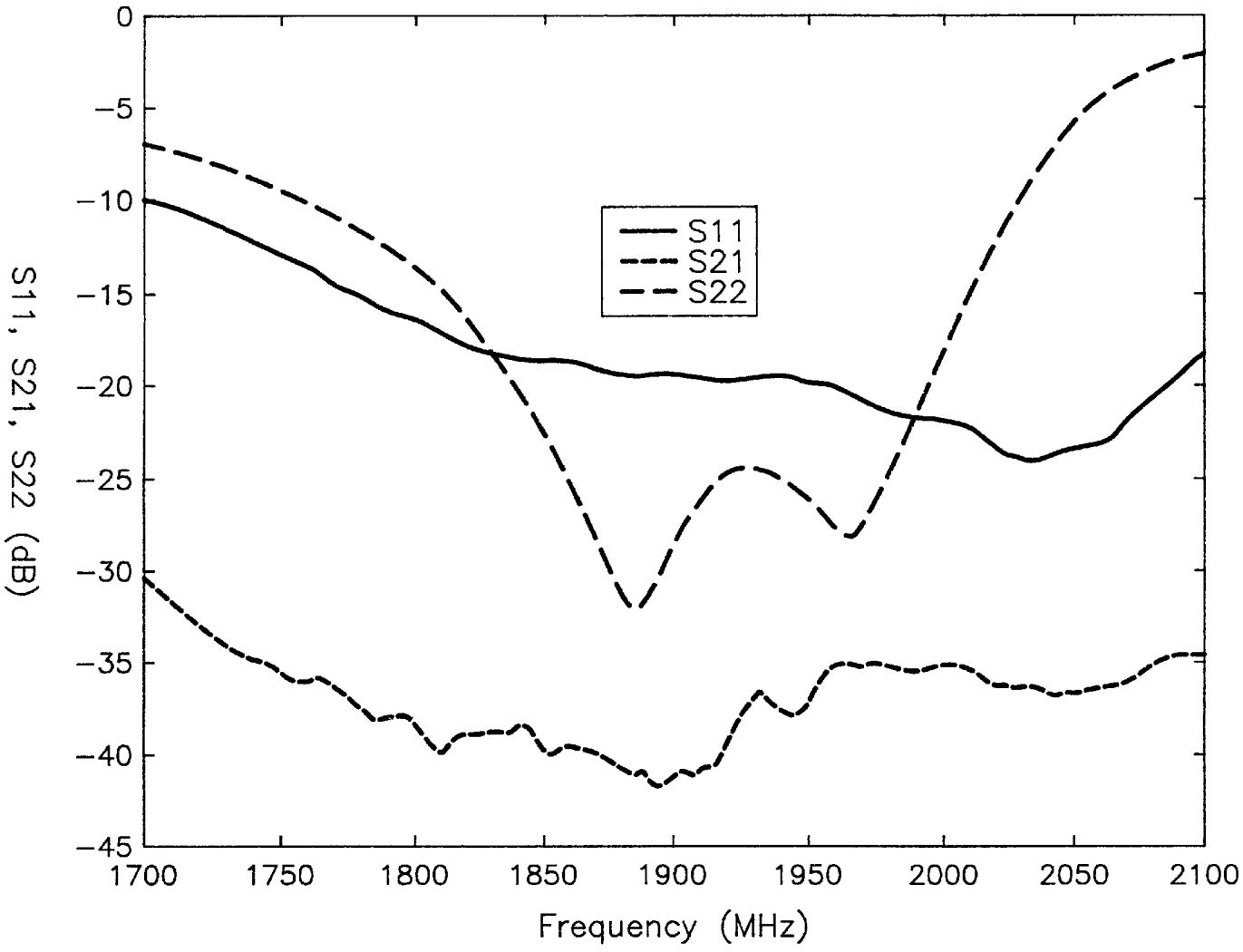
FIG. 3 is a diagram showing the return loss and the location between the two channels of the dual polarized microwaves.

Practical tests have shown that an antenna element as described above has excellent qualities in terms of effective radiated power in both channels as well as a good isolation therebetween. The diagram shown in FIG. 3 illustrates the return loss, which is greater than 19 dB for both channels (S11, S22), and an isolation (S21) of about 35 dB in the frequency band 1.85–1.99 GHz (i.e. the PCS band).

The antenna element described above may be modified within the scope of the claims. For example, the feed lines do not have to be micro strip lines but may be conventional coaxial cables with a central conductor and an outer shield, the conductor and the shield being soldered into contact with the opposite edges of the associated slot. Of course, it is also possible to stack more than one radiating patch in an antenna element.

I claim:

1. A substantially flat, aperture-coupled antenna element of the kind comprising a multilayer structure with a radiating patch arranged on a dielectric layer, an electrically conductive ground plane layer having a cross-shaped aperture with first and second crossing slots being substantially centered in relation to the patch, and a dielectric board provided with a feed network for feeding microwave energy via feed element and said cross-shaped aperture to said patch so as to cause the latter to generate a dual polarized microwave beam propagating from the antenna element, wherein said multilayer structure includes a single dielectric board provided with a planar feed network having a first feed element with a pair of feed liens extending symmetrically on each side of the aperture centre and a second feed element with a single feed line located unsymmetrically at one side of said aperture centre without crossing said first feed element, the two feed elements being oriented and dimensioned so as to excite each one of the first and second crossing slots separately from a respective microwave channel.

2. The antenna element as defined in claim 1, wherein said second feed element is located closer to said aperture centre than said first feed element.

3. The antenna element as defined in claim 2, wherein the single feed line of said second feed element is located between but at a distance from the end portions of the feed lines of said first feed element.

4. The antenna element as defined in claim 1, wherein the two feed lines of said first feed element extend substantially in parallel to each other and perpendicularly in relation to an associated one of the first and second slots.

5. The antenna element as defined in claim 4, wherein said two feed lines are substantially straight and are branched off from an associated channel line included in said network.

6. The antenna element as defined in claim 1, wherein said planar feed network is constituted by micro strip lines disposed on the side of said dielectric board facing away from said ground plane layer.

7. The antenna element as defined in claim 6, wherein the feed lines of said first and second feed elements have end stub portions extending past a point where the feed lines cross an associated one of the first and second slots at a distance therefrom.

8. The antenna element as defined in claim 7, wherein said end stub portions are bent at an angle within the plane defined by said feed network.

* * * * *